United States Patent [19]

Ferrari

[11] 4,052,521

[45] Oct. 4, 1977

[54] COATING AND CALENDARING OF 2-DIMENSIONALLY TENSIONED FABRIC

[76] Inventor: Serge Ferrari, 69390 Charly, Vernaison, Rhone, France

[21] Appl. No.: 724,667

[22] Filed: Sept. 20, 1976

Related U.S. Application Data

[63] Continuation-in-part of Ser. No. 506,815, Sept. 19, 1974, abandoned.

[51] Int. Cl.[2] ..... B29D 7/22; B05D 3/12

[52] U.S. Cl. ..... 427/173; 118/34; 118/126; 427/171; 427/176; 427/316; 427/365

[58] Field of Search ..... 118/34; 427/173, 176, 427/171, 365, 214, 369, 370, 381, 366, 390; 26/52, 72, 73; 34/158, 162, 163

[56] References Cited

U.S. PATENT DOCUMENTS

| | | | |
|---|---|---|---|
| 2,292,596 | 8/1942 | Baechtold | 118/34 |
| 2,977,665 | 4/1961 | McElrath | 427/385 R |
| 3,032,441 | 5/1962 | Beaumont et al. | 427/176 X |
| 3,044,891 | 7/1962 | Lauchenauer et al. | 427/176 X |
| 3,252,821 | 5/1966 | Christie et al. | 427/243 |

*Primary Examiner*—Morris Kaplan
*Attorney, Agent, or Firm*—Dowell & Dowell

[57] ABSTRACT

A method of coating a fabric material and calendering the material while longitudinally and transversely tensioning the material, the coating being synthetic and being applied to one side of the material, and being heated in a curing oven. Then applying more synthetic material of a similar type to the calendered and heated material and then passing it through another oven and calendering it again before the tensioning is relaxed.

2 Claims, 2 Drawing Figures

COATING AND CALENDARING OF 2-DIMENSIONALLY TENSIONED FABRIC

This application is a continuation-in-part of application Ser. No. 506,815, filed Sept. 19, 1974, now abandoned.

FIELD OF INVENTION

The present invention relates to improvements in methods of coating a fabric with layers of synthetic heat curable plastic material, such as polyvinyl chloride, resin, elastomers, etc., to produce a non-shrinking, substantially smooth resulting product while at the same time using less coating material.

BACKGROUND AND PRIOR ART

It is known that in conventional installations, the fabric is unwound from a bobbin or other similar supply support, stretched in the longitudinal direction, run through a coating machine having a doctor blade which deposits a layer of the synthetic material in question on one of its sides. The fabric thus coated then passes through a heating oven, at the outlet of which it may be subjected to a calendering operation by passing between two rotating rollers. Then, it is cooled before being finally wound on a support.

One main drawback encountered in conventional methods resides in transverse shrinkage of the fabric, which shrinkage is particularly severe when dealing with a fabric produced with synthetic fibres (polyamide or polyester). These fibres normally leave the spinning mill in a condition in which they are not heat-fixed, so that they undergo an appreciable shrinkage effect when they are subjected to an elevated temperature. Naturally, shrinkage of this type is a considerable detriment to the value of the fabric/synthetic material complex obtained.

In order to remedy this fault, it has been proposed to produce the basic fabric from yarn stabilized by a heat treatment. However, it will be understood that this is a relatively difficult operation, it also being noted that the cost of the fabric produced from yarn of this type is further increased by the fact that the latter has a weight per meter greater than that of untreated yarn, without having the better mechanical characteristics. Furthermore, fabric made from stabilized yarn has a greater coeffeicient of elongation, which is detrimental in many applications. Finally, and above all, whatever the quality of the stabilization treatment, the shrinkage phenomenon is not completely eliminated.

Now, apart from the above-mentioned drawbacks, the shrinkage of coating fabrics opposes the production of complexes in which the basic fabric is constituted by a mixture of synthetic yarn and natural, artificial or synthetic discontinuous fibres. Coated fabrics of this type would have excellent resistance to tearing owing to the presence of continuous yarn, whilst having a more agreeable texture due to the discontinuous fibres in the case of coating on one side and better adhesion of the coating to the fabric with coating on one or two sides. However, a complex of this type cannot be envisaged at the present time, owing to the very substantial shrinkage differences between the two types of textile fibres, even if the synthetics have been previously treated.

THE INVENTION

According to the invention there is provided a method for coating fabric or similar flexible supports, wherein the support is unwound and placed under longitudinal tension, coated with a layer of synthetic material, heated for the purpose of gelifying or polymerising the coated material, hot-rolled, cooled and wound-up. However, prior to its passage in a coated condition through a curing oven and through calendering apparatus, the longitudinal edges of the fabric are introduced between retaining members of a tenter which accompanies said fabric until the termination of a calendering operation and whilst still stretched in the transverse and longitudinal directions, it is subjected to at least one second similar coating operation on the same side, whilst the first coat is still hot.

In order to provide as smooth a surface of the finished coated fabric as possible while using a minimal amount of coating material to achieve the purpose, the present invention teaches the use of two successive coatings at two successive stations, rather than merely filling the fabric with a single coating in a one-stage operation. Moreover, the fabric must be coated as thinly as possible, not only for economy reasons but also to preserve flexibility of the fabric. When the fabric to be coated is initially unrolled, the plastic threads of the fabric are not all uniformly tensioned and have a strong tendency to shrink when heated. When one attempts to provide a smooth finish on one side of the fabric using only a single coating step followed by calendering and heat treating, the grain of the fabric show through to a considerable extent, and thus grain is not uniform over the entire fabric surface because some threads tend to stick up more than others above the surface of the fabric through the coating since they are not all equally tensioned. The applicant has found that by applying a first coating and heat curing that coating and immediately calendering the coating, he can make the nubs of the fabric lie down and be essentially uniform in height. Thereafter, when a second coating is applied on top of the first coating which has already been cured, a relatively thin coating can be used as the second coating because the nubs of the fabric are essentially the same height all over, and therefore it is only necessary to fill the surface of the fabric to that particular height in order to produce a fabric having a smooth and uniform appearance over its entire surface. In other words, the application of the first coating not only seals the fabric so that the second coating will not pass all the way through it, but it also holds down threads of the fabric which might otherwise stick up higher than other threads since the threads used in the initial fabric are not entirely stabilized. The continuous transverse and longitudinal tensioning applied to the fabric during the heat treating and calendering of the first coating and during the entire second coating, heating and calendering steps, also pulls the threads down and tends to hold them essentially at the same height, whereupon the tensioned threads will be set at the crossings of the warp and weft by the subsequent calendering operation. Thus, the thickness of the second coating can be reduced, and is much less than the thickness which would be required if the fabric were released from tension and allowed to cool between the two coating steps.

It is the object of the improvements to which the present invention relates, to remedy the aforementioned drawbacks and to achieve the production of a smooth-surface coated fabric which is not subject to any shrinkage during its manufacture.

THE DRAWINGS

Figure 1:
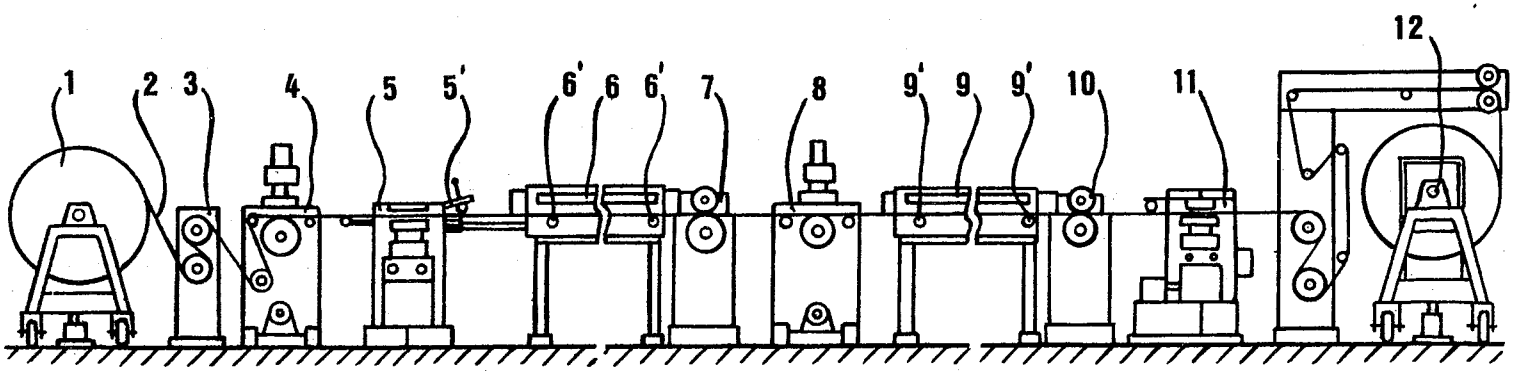
FIG. 1 shows diagrammatically the general arrangement of a coating machine according to the invention.

Referring to the drawings, the installation illustrated in FIG. 1 comprises an unwinding station able to receive a bobbin or reel 1 supporting the fabric 2 to be coated in the wound state. This fabric 2 passes through a longitudinal tensioning mechanism 3 before being supplied to a coating station 4 arranged in the customary manner. This station 4, appropriately supplied with synthetic material, deposits a film or layer of synthetic material on the fabric 2 by means of a doctor blade.

According to the invention, on leaving the coating station 4, the fabric 2 passes to a station 5, in wich its longitudinal edges are introduced in lateral retaining means (grippers, hooks etc.) of a tenter of the type used in the textile-finishing industry or the like. The reference numeral 5' designates one of the grippers of a tenter of this type, supported by lateral chains longitudinally displaced in exact synchronism with the fabric 2. Naturally, these chains are guided in order to keep the coated fabric 2 in a stretched condition in the transverse direction, without any possibility of shrinkage.

The coated fabric 2 retained in this way by the tenter then passes through a curing oven 6 in which the synthetic material deposited forms a gel or polymerises in the usual manner, being at least partially cured at this stage. In this oven, the coated fabric 2 is supported from a place to place by transverse drums 6' able to oppose any sagging of said fabric in the transverse or longitudinal direction, these drums being cooled and driven in rotation. On leaving the oven 6, the fabric 2, still retained by the tenter, travels in hot condition to a calender 7, comprising two superimposed rollers, one of which may have projecting parts able to make an impression in the layer of synthetic material.

On leaving the calender and whilst it is still in a hot state, the coated fabric 2, still retained by the tenter, is subject to a new coating with similar heat curable plastic applied on the same side of the fabric at a second station 8 similar to the first station 4. It will be understood that this coating is carried out on a complex which has already been heat-treated and subjected to calendering, such that the smoothness characteristics of the second layer thus deposited are considerably improved.

After this coating operation, the fabric 2 passes successively through a second curing oven 9 provided with support rollers 9' and a calendering station 10 identical to the first. Then the tenter which was tensioning the fabric widthwise is removed at station 11, and the fabric is passed through tensioning rollers, is further cooled, and wound-up at a station 12.

Tests have shown that a coated fabric is obtained having no shrinkage effect, in the sense that its width when coated and wound-up at the station 12 is absolutely identical to the width of fabric 2 wound on the initial support 1, whatever the nature (natural, artificial, synthetic, etc.) and constitution of this fabric. Consequently, it is possible to use untreated yarn or fibres, which are clearly lighter. In addition and above all, it is possible, particularly in the weft, to alternate various types of material without any risk of differential shrinking, which makes it possible to create new articles from the coated fabric obtained.

It is interesting to note that if the widthwise stretching produced by the tenter 5', and the longitudinal tensioning ensured between the longitudinal tensioning station 3 and the second calender 10 oppose any shrinkage nevertheless the warp and weft threads themselves do undergo shrinkage, which has the result of flattening the fabric and smoothing out the nubs from the surface of the latter. It has been possible to verify that the decrease in thickness was of the order of 25%, so that ultimately the fabric 2 was in the form of a virtually smooth support similar to a strong sheet of paper. Under these conditions it will be understood that perfectly regular coating is achieved. With an equal weight of synthetic material per square meter, the covering is clearly improved and the adhesion of this material to the fabric is considerably facilitated. In addition, depending on the textures, the synthetic material may penetrate the fabric, through which is passes at least partially, such that the reverse side is finally covered as well as the front side.

Figure 2:
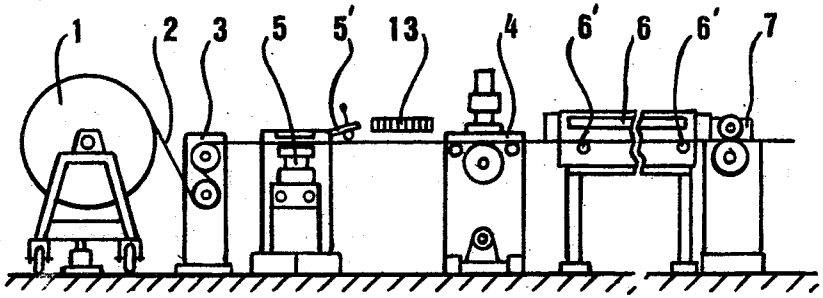
FIG. 2 is a partial view of a modified form thereof.

For the purpose of further improving the uniformity of coating, it is possible to adopt the modification illustrated in FIG. 2, in which the positioning of the tenter for widthwise stretching (station 5) is carried out prior to the first coating step (station 4). In other words, the fabric or support 2 receives the film of synthetic material when it is already transversely stretched, a heating unit 13 being advantageously provided upstream of the coating station 4 for ensuring heat tensioning and at least temporary fixing of longitudinal and transverse forces which are exerted on the fabric.

Naturally any number of coating operations in excess of two may be provided, depending on the desired thickness of the coating.

ILLUSTRATIVE EXAMPLES

The present process is illustrated by the following examples in which a coated fabric is made, suitable for covering cargo on trucks, for making awnings, tents, clothings, or other similar heavy duty service. The fabric is a woven fabric having similar warp and weft yarns comprising synthetic continuous filaments, preferably high strength polyamid or polyester of 210 to 2000 denier, the weight of fabric in this range varying approximately from 70 to 350 grams per square meter. As stated above, it is a particular feature of this invention that the fabric can be woven using un-set filaments. The coating material is preferably polyvinyl chloride resin, although where ovens are equipped with accurate heat control and safety means preventing firing, it is also satisfactory to use elastomeric coating materials, or polyurethane or acrylic resins. The coating adds about 150 to 1000 grams per square meter to the weight of the fabric itself within the denier range quoted above, so that the weight of the coated fabric will be in the range of 220 to 1350 grams per square meter.

The following specific example is typical:

The support fabric comprises a woven polyester yarn of 1000 denier including 200 filaments twisted together 60 turns per meter. The filaments are not preset and the weave includes 8 yarns per centimeter. The cloth is 183 centimeters in width and weights 180 grams per square meter. The fabric moves through the machine at a linear rate of 17 meters per minute, and is subjected to two successive coating operations.

The first coating step provides an under-layer which is designed to adhere as well as possible to the fabric filaments. The polyester includes 11% Di-isodecylphtalate, 30% 7-11 linear phlate, 53% PVC resin, 0.82% pigment, 2.10% isocyanurate bonding agent, and 3.08% other agents including bactericide, fungicide and ultra violet absorber. The temperature in the first curing oven is 165° C, and calendering of the fabric immediately follows the heat curing stage.

The second coating step is similar except that the linear speed of the fabric through the machine is preferably reduced somewhat to about 13 meters per minute. The coating material is the same but it is applied in somewhat different quantity. A higher oven temperature is used following the second coating step, the temperature being about 180° C. This higher temperature plasticizes the PVC resin more completely which provides a smoother surface for the finished product. The fabric is again calendered.

The tension produced in the filaments is about 0.9 gram per denier. Thus each 1000 denier yarn is subjected to a tension of about 900 grams, and since the weave includes 8 yarns per centimeter, the tension on the fabric as the yarn shrinks is about 7.2 kilograms per centimeter at the elevated oven temperatures.

If the fabric were free to shrink, its dimensions would shrink about 17% at the elevated temperatures, but the tensioning means prevent such shrinkage in overall dimensions. The shrinkage therefore goes into reduction of thickness of the fabric to the extent of about 20%. Therefore the surface of the fabric is made very regular at the nubs, and the amount of coating material required to make a smooth surface is correspondingly reduced. As stated above the initial width of the fabric is 183 centimeters. The tenters prevent it from diminishing, but the selvage portions of the fabric are not regular. Therefore about 15 millimeters of the edge is severed on each side of the fabric, reducing its width to 180 centimeters for the finished product.

The improved weight per meter of this product can be seen by comparing a four layer product (coated on both sides) with a similar product made according to prior art methods using the same initial fabric. The present product weighed 580 grams per square centimeter as compared with a weight of 670 grams per square centimeter for the prior art product having a poorer surface smoothness, but similar tensile strength and tearing strength.

This invention is not to be limited by the above recited examples and drawings, for obviously changes can be made within the scope of the following claims.

I claim:

1. The method of coating a flexible fabric having nubs on its surface with a coating of synthetic heat curable plastic material to produce on one side of the fabric a smooth and uniform coating thereover covering the nubs, comprising the steps of:

drawing the fabric through a treating path while longitudinally tensioning the fabric;

gripping the fabric along its edges while passing through said path and tensioning the fabric transversely of said path;

applying a first coating of heat curable plastic material to said one side of said fabric;

heat curing within said path said first coating on said fabric and calendering said one side of the fabric and first coating to cause the nubs within the cured coating to be essentially uniform in height, while maintaining said longitudinal and transverse tensioning;

applying a second coating of heat curable plastic material within said path to the same side of the fabric sufficient to fill the surface of the first coating to include said height of the calendered nubs while the fabric and first coating are still heated, and calendering said fabric and second coating while maintaining said longitudinal and transverse tensioning;

heat curing within said path said second coating on said fabric while maintaining said longitudinal and transverse tensioning; and then releasing said tensioning and rolling up the coated fabric.

2. The method according to claim 1, wherein said fabric is heated in said path prior to the application of said first coating.

* * * * *